US008606147B2

(12) United States Patent
Kidokoro

(10) Patent No.: US 8,606,147 B2
(45) Date of Patent: Dec. 10, 2013

(54) FUSING DEVICE FOR IMAGE FORMING APPARATUS AND IMAGE FORMING APPARATUS HAVING THE SAME

(75) Inventor: Takashi Kidokoro, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 275 days.

(21) Appl. No.: 13/067,032

(22) Filed: May 3, 2011

(65) Prior Publication Data

US 2012/0093529 A1 Apr. 19, 2012

(30) Foreign Application Priority Data

Oct. 15, 2010 (KR) ..... 10-2010-0100722

(51) Int. Cl.
*G03G 15/16* (2006.01)

(52) U.S. Cl.
USPC ..... 399/122; 399/320; 399/330; 399/334

(58) Field of Classification Search
USPC ..... 399/122, 320, 330, 334
See application file for complete search history.

(56) References Cited

U.S. PATENT DOCUMENTS

| | | | | |
|---|---|---|---|---|
| 7,995,957 | B2 * | 8/2011 | Sone et al. | 399/330 |
| 2002/0006296 | A1 * | 1/2002 | Omoto et al. | 399/330 |
| 2008/0240805 | A1 * | 10/2008 | Kinouchi et al. | 399/328 |

* cited by examiner

*Primary Examiner* — Ryan Walsh
(74) *Attorney, Agent, or Firm* — Staas & Halsey LLP

(57) ABSTRACT

A fusing device for an image forming apparatus that heats an infused image on a printing medium by an electromagnetic induction heating method includes a heated member having a metallic layer; a plurality of main cores disposed to be spaced apart a predetermined distance from a surface of the heated member, the plurality of main cores arranged to be spaced apart a predetermined interval from each other in a length direction of the heated member; and a main coil wound to surround the plurality of main cores.

18 Claims, 8 Drawing Sheets

FUSING DEVICE FOR IMAGE FORMING APPARATUS AND IMAGE FORMING APPARATUS HAVING THE SAME

CROSS-REFERENCE TO RELATED APPLICATIONS

This application claims the benefit under 35 U.S.C. §119 (a) from Korean Patent Application No. 2010-100722 filed Oct. 15, 2010 in the Korean Intellectual Property Office, the disclosure of which is incorporated herein by reference in its entirety.

BACKGROUND

1. Field

The embodiments relate to a fusing device for an image forming apparatus. More particularly, the embodiments relate to an electromagnetic induction heating type fusing device.

2. Description of the Related Art

Generally, a fusing device used in an image forming apparatus is constituted to have a halogen lamp that is arranged in an inner space within a metallic fusing roller and heats the fusing roller. However, the fusing device using this heating method consumes a large amount of energy when rapidly heating and it takes a long time for the fusing device to heat up the fusing roller to a fusing temperature. To overcome these drawbacks, fusing devices using an electromagnetic induction heating method have been developed and used.

The electromagnetic induction heating type fusing device generally uses an outer electromagnetic induction heating type fusing device that is configured to have a thin fusing roller or a thin heating belt and an induction heating member disposed outside the fusing roller or the heating belt so as to heat the fusing roller or the heating belt by an electromagnetic induction from the outside of the fusing roller or the heating belt. In the outer electromagnetic induction heating type fusing device (hereinafter referred to as an IH fusing device), a coil to generate a magnetic flux is arranged outside a heated member, such as a fusing roller or a heating belt, etc, and a ferrite core to guide the magnetic flux to the heated member is arranged outside the coil. A sectional area of the coil is determined by a size of the magnetic flux that can sufficiently heat the heated member until a predetermined time. Also, since the coil is arranged to be spaced apart a predetermined distance from the heated member, for securing a necessary heating sectional area it is required to reduce a thickness of the coil in a sectional direction thereof so that the coil has a large wiring angle with respect to the heated member. Here, the wiring angle of the coil presents an angle between two lines that join a center point of the heated member and opposite side ends of the coil.

According to a configuration of the outer electromagnetic induction heating type fusing device, because the wiring angle of the coil wound around a surface facing the heated member should be over a predetermined angle, it is difficult to reduce a diameter of the heated member. Further, for preventing temperature of the opposite ends of the heated member from lowering, it is required that the coil is formed to cover a size larger than a width of a printing medium in a length direction of the heated member. Therefore, there is a problem that the fusing device is formed in a large size.

SUMMARY

The present invention has been developed in order to overcome the above drawbacks and other problems associated with the conventional arrangement. An aspect of the present invention is to provide a fusing device for an image forming apparatus that can shorten a heating time—the time it takes until a heated member is heated to a predetermined temperature—that can have a compact size by winding a coil around a ferrite core to reduce a diameter of the heated member in a fusing device using an outer electromagnetic induction heating method.

The above aspect and/or other features can substantially be achieved by providing a fusing device for an image forming apparatus that heats an infused image on a printing medium by an electromagnetic induction heating method. The fusing device may include: a heated member having a metallic layer; a plurality of main cores disposed to space apart a predetermined distance from a surface of the heated member, the plurality of main cores arranged to space apart a predetermined interval from each other in a length direction of the heated member; and a main coil wound to surround the plurality of main cores.

Each of the plurality of main cores may include core arms extending from opposite ends of the main core toward the surface of the heated member.

The main core may be formed in an arc shape corresponding to the surface of the heated member.

The main coil may be wound in a width direction of each of the plurality of main cores to surround all the plurality of main cores.

A bottom core may be disposed between the heated member and the core arms. The bottom core may be attached to the core arms by a resin adhesive.

The bottom core may have a length corresponding to a length of the heated member.

The plurality of main cores, the core arms, and the bottom core may be formed of a ferrite material.

The core arms may be formed in a direction perpendicular to the surface of the heated member.

When the heated member has a circular section, a length of the core arm may be determined according to a diameter of the heated member.

The heated member may be a roller or a stepless belt unit.

The stepless belt unit may include a heat pipe disposed adjacent to the plurality of main cores; a supporting roller disposed to space apart from the heat pipe; and a fusing belt disposed to surround the heat pipe and the supporting roller, the fusing belt to rotate to transmit a heat generated in the heat pipe toward the supporting roller.

The fusing device may include a cancel coil wound around at least one main core corresponding to opposite ends of the heated member among the plurality of main cores, the cancel coil spaced apart from the main coil. The cancel coil may be separately wound around each of the plurality of main cores.

The fusing device may include a fusing control part to control an electric power to be applied to the main coil, wherein the fusing control part controls the electric power to be applied to the cancel coil according to a size of the printing medium that the image forming apparatus recognizes.

The main coil may include, a first coil wound around a plurality of main cores corresponding to a middle portion of the heated member; a second coil wound around at least one main core corresponding to a first end of the heated member; and a third coil wound around at least one main core corresponding to a second end opposite to the first end of the heated member.

Each of the second coil and the third coil may be wound around each of opposite end main cores of the plurality of main cores wound by the first coil, and may be spaced apart a predetermined distance from the first coil.

The fusing device may include a fusing control part to control an electric power to be applied to the first, second and third coils, wherein the fusing control part controls the electric power to be applied to the first, second and third coils according to a size of the printing medium that the image forming apparatus recognizes.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
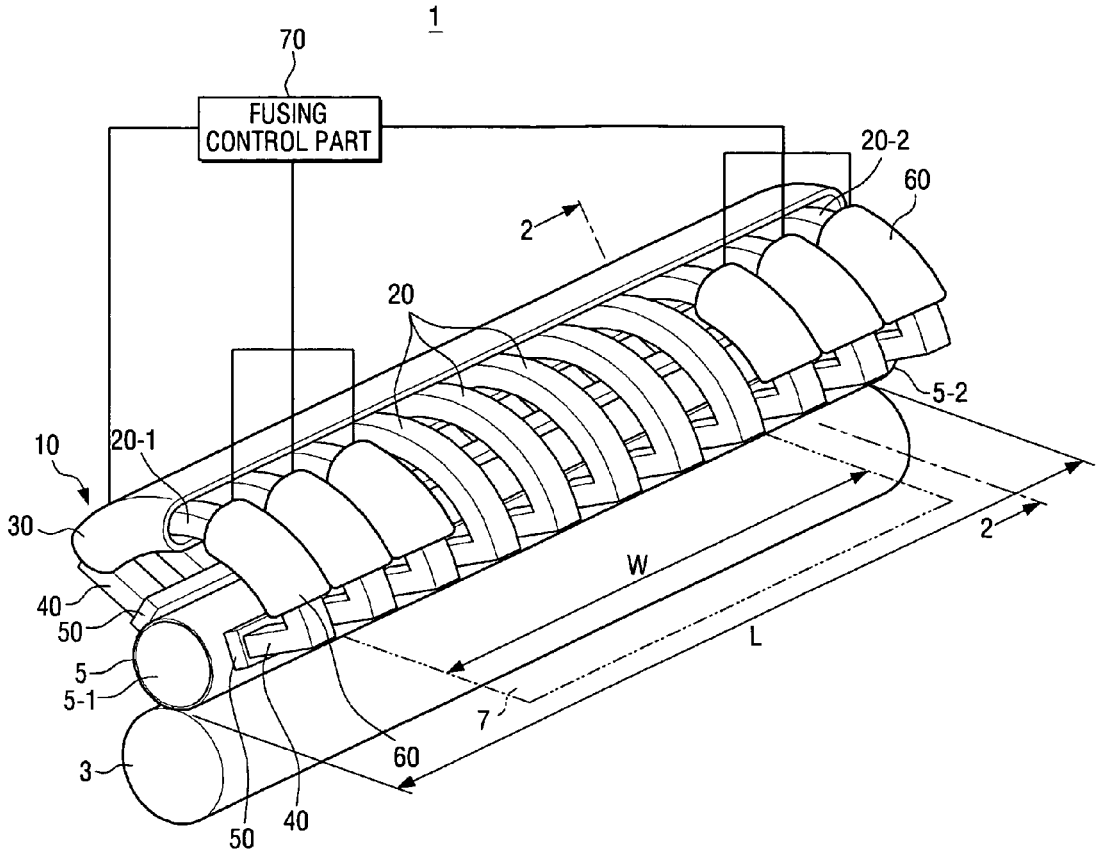
FIG. 1 is a perspective view illustrating a fusing device according to an embodiment.

Hereinafter, certain exemplary embodiments of the present invention will be described in detail with reference to the accompanying drawings, where like reference numerals will be understood to refer to like parts, components and structures.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention. Further, dimensions of various elements in the accompanying drawings may be arbitrarily increased or decreased for assisting in a comprehensive understanding of the invention.

Figure 2:
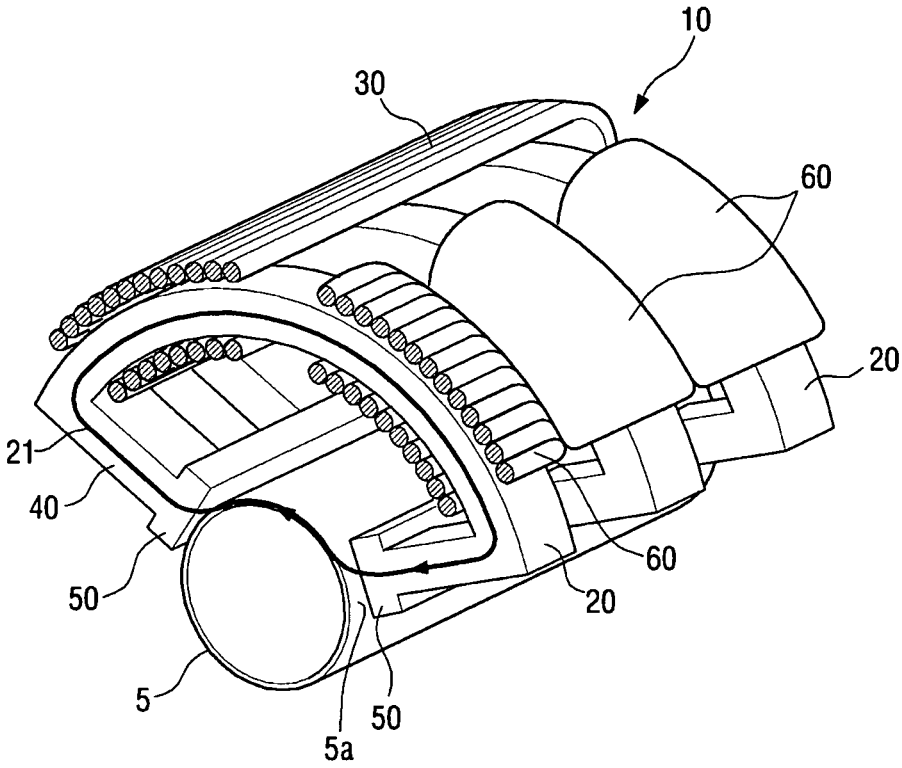
FIG. 2 is a partial perspective view illustrating the fusing device taken along a line 2-2 in FIG. 1.

Also, it is noted that a main coil and a cancel coil in FIG. 2 are illustrated in a coil shape but the main coil, cancel coils, etc in the other drawings of FIGS. 1 to 7 are not illustrated in a coil shape for clarity and concision.

The present invention relates to a fusing device 1 for an image forming apparatus that heats an infused image on a printing medium by a heat generated by an electromagnetic induction heating method to fuse the image on the printing medium. FIG. 1 is a perspective view illustrating a fusing device 1 according to an embodiment, and FIG. 2 is a partial perspective view illustrating the fusing device 1 taken along a line 2-2 in FIG. 1.

Referring to FIGS. 1 and 2, the fusing device 1 according to an embodiment may include a pressing member 3, a heated member 5, and a magnetic flux generating unit 10.

The pressing member 3 presses the heated member 5 to form a fusing nip N (see FIG. 8) therebetween and applies a pressure to a printing medium 7 passing through the fusing nip N. In the present embodiment, the pressing member 3 is configured as a pressing roller having a roller shape. The pressing roller 3 is pressed against the heated member 7 by a pressure applying member (not illustrated) such as a spring.

The heated member 5 faces the pressing member 3 and applies a predetermined heat to the printing medium 7 passing through the fusing nip N. In the present embodiment, the heated member 5 is configured as a heating roller having a roller shape. The heating roller 5 may include metallic layer. Thinning the metallic layer of the heating roller 5 can reduce a heat capacity of the heating roller 5, thereby realizing a rapid heating. An aluminum pipe may be used as an example of the heating roller 5. The heated member 5 is not limited to the heating roller and may be formed in various constructions such as a fusing belt 63 of a stepless belt unit 6 (see FIG. 6) as long as they can apply a predetermined heat to the printing medium 7 passing through the fusing nip N.

The magnetic flux generating unit 10 generates heat in the heated member 5, that is, the heating roller by an electromagnetic induction heating method to fuse an infused image on the printing medium 7 passing through the fusing nip N between the heating roller 5 and the pressing roller 3. The magnetic flux generating unit 10 may include a plurality of main cores 20 disposed outside the heating roller 5 and a main coil 30 wound around the plurality of main cores 20.

Figure 3:
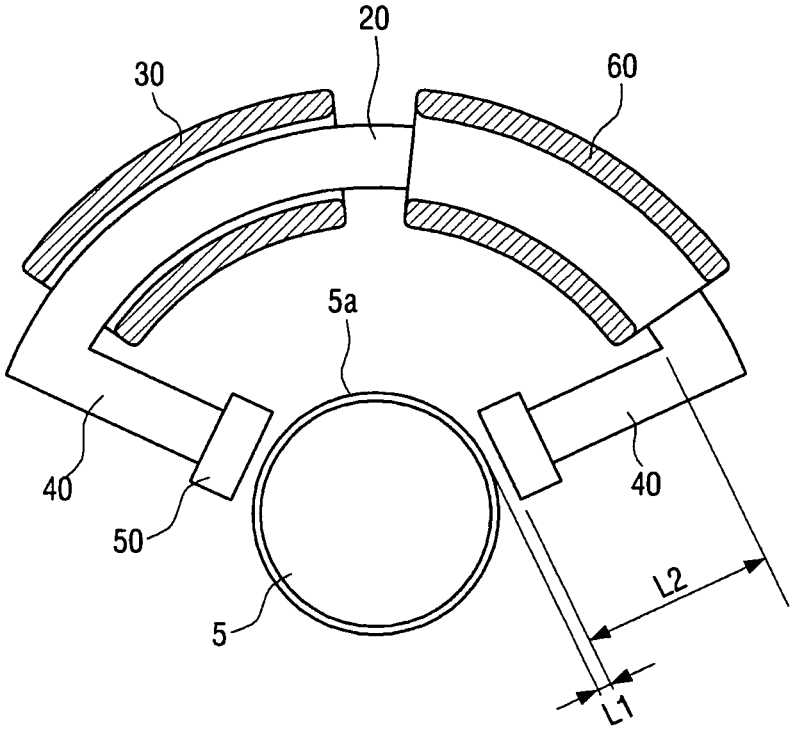
FIG. 3 is a sectional view illustrating a bottom core connected to a core arm of a fusing device according to an embodiment.

The plurality of main cores 20 is, as illustrated in FIGS. 1 to 3, disposed to space apart a predetermined distance outward from a surface 5*a* of the heating roller 5. Also, the plurality of main cores 20 is arranged to be spaced apart a predetermined interval from each other in a length direction of the heating roller 5. The plurality of main cores 20 has a number covering a whole length of the heating roller 5 in a predetermined interval in the length direction of the heating roller 5. In other words, in FIG. 1, a leftmost main core 20-1 is arranged to correspond to a first end 5-1 of the heating roller 5 and a rightmost main core 20-2 is arranged to correspond to a second end 5-2 (an end opposite to the first end) of the heating roller 5. The plurality of main cores 20 may be formed in an arc shape corresponding to a circumferential surface 5*a* of the heating roller 5, respectively. That is, each of the plurality of main cores 20 may be formed in a bar shape bent in an arc shape corresponding to the surface 5*a* of the heating roller 5. However, a curvature of the main core 20 is not limited to the same dimension as that of the heating roller 5, and may have various curvatures over or less than the curvature of the heating roller 5. Also, the shape of the main core 20 is not limited to the arc shape as illustrated in FIGS. 1 to 3. As long as the main core 20 can generate a proper heat in the surface 5*a* of the heating roller 5, the main core 20 may be formed in various shapes. The main core 20 may be formed of a ferrite material.

The main coil 30 may be, as illustrated in FIG. 1, wound to surround (or enclose) all the plurality of main cores 20. In other words, the main coil 30 can be wound to surround all the plurality of main cores 20 in a width direction of each of the main cores 20, namely, all the plurality of main cores 20 from the main core 20-1 corresponding to the first end 5-1 of the heating roller 5 to the main core 20-2 corresponding to the second end 5-2 of the heating roller 5. As a result, the main coil 30 includes a first portion that locates below the plurality of main cores 20 and faces the heating roller 5 and a second portion that locates above the main cores 20. A separate core is not arranged to cover the main coil 30 above the magnetic flux generating unit 10. Also, the main coil 30 is wound in a predetermined winding number in a length direction of each of the plurality of main cores 20, that is, in an arc direction or a magnetic flux direction 21 of the main core 20 as illustrated in FIG. 2. In other words, the main coil 30 is wounded to surround the plurality of main cores 20 in the outside thereof in a direction substantially parallel to the circumferential direction of the heating roller 5.

Each of the plurality of main cores 20 may include two core arms 40 extending from opposite ends of the main core 20 toward the surface 5*a* of the heating roller 5. The core arms 40 may be formed in a direction substantially perpendicular to the surface 5*a* of the heating roller 5. The core arms 20 guide a magnetic flux generated in the main core 20 surrounded by the main coil 30 to the heating roller 5 as arrow 21 as illustrated in FIG. 2.

Figure 4:
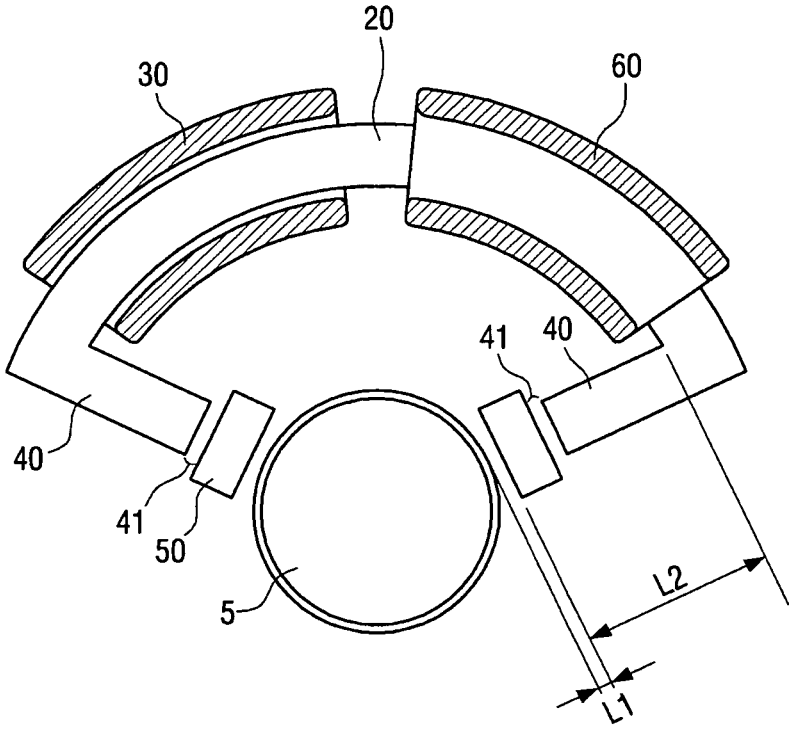
FIG. 4 is a sectional view illustrating a bottom core spaced apart from a core arm of a fusing device according to an embodiment.

Further, a bottom core 50 may be disposed between the heating roller 5 and the plurality of core arms 20. The bottom core 50 can be omitted but the bottom core 50 is preferably disposed for allowing a magnetic force that is transmitted to the heating roller 5 through the plurality of core arms 40 to be uniformly transmitted to the heating roller 5. The bottom core 50 may be formed in a single piece with the core arm 40. Alternatively, the bottom core 50 may be separately formed in a bar shape, and then may be fixed on ends of the core arms 40 by an adhesive, such as a resin adhesive, etc, as illustrated in FIG. 3. In another example, the bottom core 50 may be disposed to space apart from the core arm 40 as illustrated in FIG. 4. In this case, the bottom cores 50 and the core arms 40 may be supported by a supporting member that is not illustrated in FIG. 4. Also, the bottom core 50 may be formed to have a length corresponding to the length L of the heating roller 5. Alternatively, the bottom core 50 may be formed to connect two or more bottom cores having a length shorter than the length L of the heating roller 5 using an adhesive so as to have a length corresponding to the length L of the heating roller 5. The core arms 40 and the bottom cores 50 may be formed of a ferrite material as the main core 20.

Figure 5:
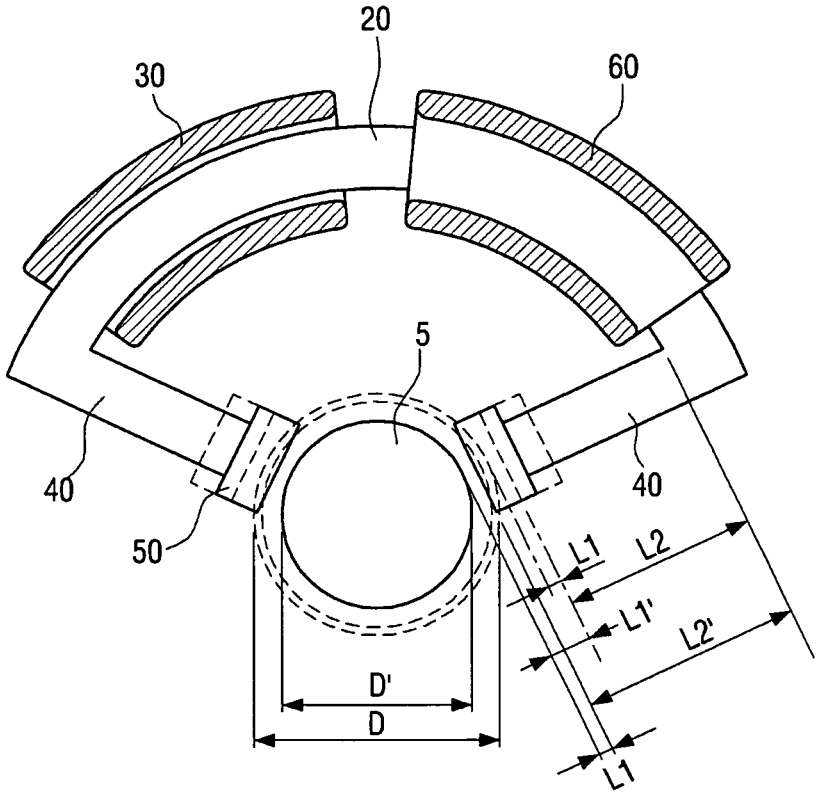
FIG. 5 is a view for explaining a relationship between a diameter of a heated member and a core arm in a fusing device according to an embodiment.

For reducing a first page out time (FPOT) in the electromagnetic induction heating type fusing device, the heating roller 5 is required to have a small heat capacity. For the small heat capacity the heating roller 5 may be formed to have a smaller diameter. If the diameter of the heating roller 5 is decreased, a distance between the heating roller 5 and the bottom core 50 is increased. For example, as illustrated in FIG. 5, if the diameter of the heating roller 5 is reduced from D to D', the distance between the heating roller 5 and the bottom core 50 is increased from L1 to L1'. An efficiency of induction heating in the electromagnetic induction heating method relates to the distance (L1, L1' in FIG. 5) between the heated member 5 (the heating roller in the present embodiment) and bottom core 50. If there is no bottom core 50, the efficiency of induction heating relates to a distance between the heating roller 5 and the core arms 40. Therefore, for constantly maintaining the efficiency of the induction heating, the distance L1 between the heating roller 5 and the bottom core 50 is required to be maintained in a constant dimension. Therefore, when decreasing the diameter of the heating roller 5, the distance L1 between the heating roller 5 and the bottom core 50 is kept in an original dimension and the core arm 40 is extended to have from a length L2 to a length L2'. In other words, when the heated member 5 is a heating roller having a circular section, the distance between the heating roller 5 and the bottom core 50 is maintained in a constant dimension and the length of the core arm 40 is determined according to a variation of the diameter of the heating roller 5.

The fusing device 1 for an image forming apparatus according to an embodiment of the present invention may further include a cancel coil 60. Referring to FIG. 1, the cancel coils 60 are disposed at three main cores 20 near opposite ends of the heating roller 5 in the length direction of the heating roller 5 among the plurality of main cores 20. The cancel coil 60 is wound around the main core 20 parallel to and apart from the main coil 20. When the printing medium 7 having a width smaller than the length L of the heating roller 5 passes through between the heating roller 5 and the pressing roller 3, the cancel coil 60 prevents portions of the heating roller 5 (non-paper passing area) that do not contact the printing medium 7 from overheating. The cancel coil 60 generates a magnetic flux in an opposite direction of the magnetic flux generated by the main coil 30 to prevent the non-paper passing area of the heating roller 5 from overheating.

Therefore, the cancel coil 60 may be independently wound around each of plurality of main cores 20 corresponding to the non-paper passing area of the heating roller 5. As well as the main coil 30, the cancel coil 60 is also wound to surround the outside of the main core 20 so that the main core 20 locates inside the cancel coil 60. As illustrated in FIG. 1, in the present embodiment, six cancel coils 60 are wound around six main cores 20, respectively.

Also, the fusing device 1 of an image forming apparatus according to an embodiment may further include a fusing control part 70 that controls an electric power to be applied to the main coil 30 and the cancel coils 60. The fusing control part 70 controls the electric power to be applied to the cancel coils 60 according to a size of the printing medium 7 that the image forming apparatus 100 (see FIG. 8) recognizes using a paper sensor, an input by a user, etc. For example, when the printing medium 7 has a width corresponding to the whole length L of the heating roller 5, the fusing control part 70 applies the electric power to only the main coil 30 and no electric power to the cancel coils 60. When the printing medium 7 has a width smaller than the length L of the heating roller 5, the fusing control part 70 applies the electric power to the main coil 30 and, at the same time, the fusing control part 70 applies the electric power to some cancel coils 60 corresponding to the non-paper passing area of the heating roller 5 on which the printing medium 7 does not pass to eliminate the magnetic fluxes generated in some main cores 20 corresponding to the non-paper passing area, thereby preventing the non-paper passing area from overheating. The fusing control part 70 may be formed as a portion of a controller (not illustrated) to entirely control the image forming apparatus 100 or in a separate part.

Hereinafter, operation of the fusing device 1 for an image forming apparatus according to an embodiment having the above-described configuration will be explained with reference to accompanying FIGS. 1, 2 and 8.

Before the printing medium 7 onto which a developer image is transferred in the developing device 130 advances into the fusing nip N of the fusing device 1, the fusing control part 70 applies the electric power to the main coil 30. After the electric power is applied to the main coil 30, as illustrated in FIG. 2, a magnetic flux is generated in the main core 20 locating inside the main coil 30, and then the magnetic flux is transmitted to the heating roller 5 with maintaining a magnetic flux density through two core arms 40 extending from the opposite ends of the main core 20 and the bottom cores 50.

The magnetic flux transmitted to the heating roller 5 generates an eddy current in the surface 5*a* of the heating roller 5 to heat the surface 5*a* of the heating roller 5.

The heating roller 5 heated by the magnetic flux heats the printing medium 7 advanced into the fusing nip N so that the developer image is fused on the printing medium 7.

When the width of the printing medium 7 advanced into the fusing device 1 is smaller than the length L of the heating roller 5, the fusing control part 70 applies the electric power to the cancel coils 60 corresponding to the non-paper passing area to eliminate the magnetic flux generated in the main core 20 by the main coil 30. Thus a portion of the heating roller 5 corresponding to the non-paper passing area is not heated by the main coil 30 so that overheating of the heating roller 5 is prevented.

According to an embodiment, because the heated member 5 can be formed to have a smaller diameter, the fusing device 1 can be formed to have a compact size. Also, because the heat capacity of the heated member 5 may be reduced, a performance of raising a temperature of the fusing device 1 is improved, thereby reducing FPOT. Also, the cancel coil 60 can be operated selectively according to a size of the printing medium 7 so that the heated member 5 is prevented from overheating.

Figure 6:
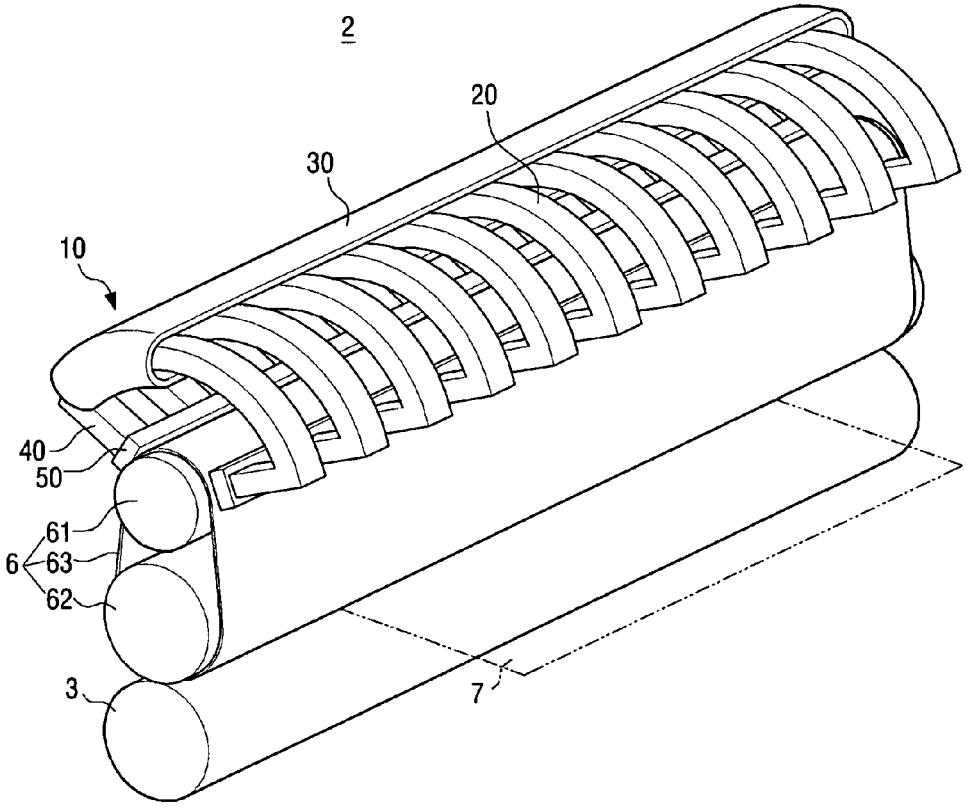
FIG. 6 is a perspective view illustrating a fusing device according to an embodiment having a stepless belt unit as a heated member.

FIG. 6 is a perspective view illustrating a fusing device 2 according to an embodiment having a stepless belt unit 6 as the heated member 5.

Referring to FIG. 6, the fusing device 2 according to an embodiment may include the pressing member 3, the stepless belt unit 6, and the magnetic flux generating unit 10. The pressing member 3 and the magnetic flux generating unit 10 are the same as or similar to those of the above-described embodiment, and therefore, a detailed explanation thereof is omitted.

The stepless belt unit 6 is the heated member that is heated by the magnetic flux generating unit 10 and may include a heat pipe 61, a supporting roller 62, and a fusing belt 63. The heat pipe 61 may be disposed adjacent to the plurality of main cores 20 of the magnetic flux generating unit 10. In detail, the heat pipe 61 is disposed between the bottom cores 50 that are disposed at the ends of the core arms 40 extending from opposite ends of each of the plurality of main cores 20. The supporting roller 62 is spaced apart from the heat pipe 61 and faces the pressing member 3, that is, the pressing roller. The fusing belt 63 is disposed to surround the heat pipe 61 and the supporting roller 62. The fusing belt 63 moves in an endless track motion by the heat pipe 61 and the supporting roller 62, thereby transmitting the heat that is generated on the surface of the heat pipe 61 by the magnetic flux generating unit 10 toward the supporting roller 62. The fusing belt 63 heated by the heat pipe 61 moves toward the supporting roller 62 so as to heat the printing medium 7 advanced into a fusing nip between the pressing roller 3 and the fusing belt 63 supported by the supporting roller 62. Then the printing medium 7 passing through between the fusing belt 63 and the pressing roller 3 receives the heat and pressure from the fusing belt 63 and the pressing roller 3 so that the developer image is fused on the printing medium 7.

At this time, because the heat pipe 61 transmits rapidly heat, when fusing the printing medium 7 having a width smaller than the length of the heat pipe, the non-paper passing area of the heat pipe 61 is not overheated. Therefore, in the present embodiment, the heat pipe 61 can do the function of the cancel coil 60 of the above-described embodiment so that no separate cancel coils 60 are required to be disposed.

Figure 7:
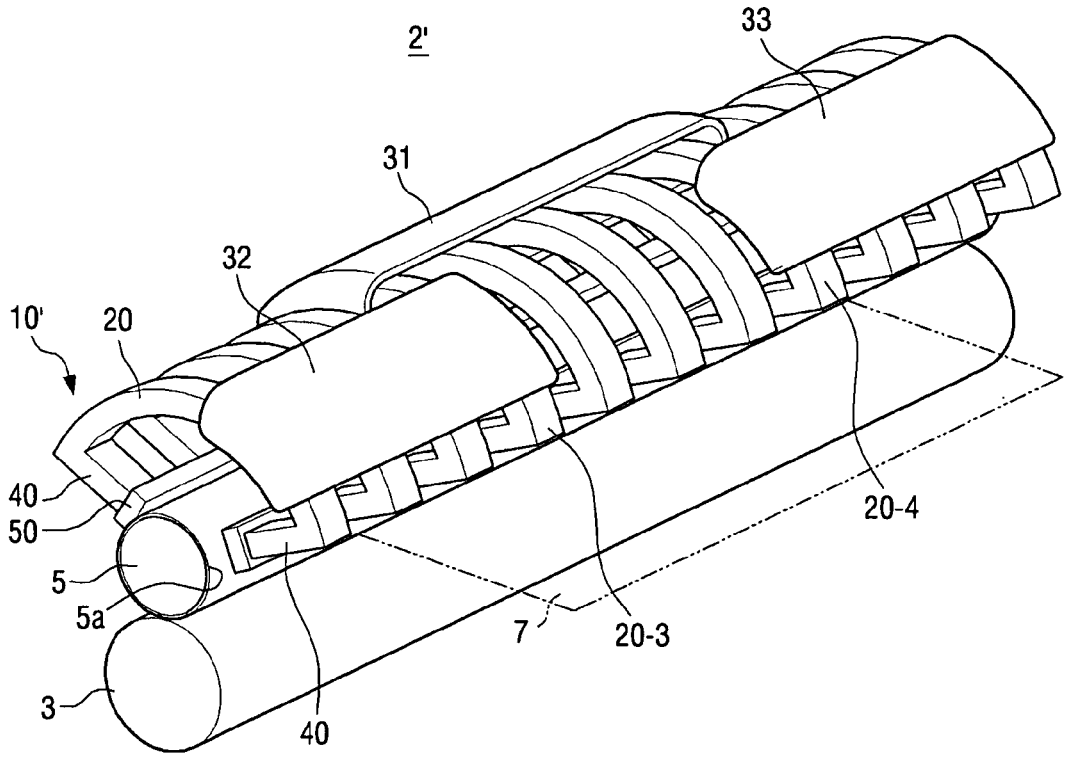
FIG. 7 is a perspective view illustrating a fusing device according to another embodiment.

FIG. 7 is a perspective view illustrating a fusing device 2' of an image forming apparatus according to another embodiment.

Referring to FIG. 7, the fusing device 2' according to an embodiment may include the pressing member 3, the heated member 5, and a magnetic flux generating unit 10'. The pressing member 3 and the heated member 5 are the same as or similar to those of the above-described embodiment, and therefore, a detailed explanation thereof is omitted.

The magnetic flux generating unit 10' may include a plurality of main cores 20 that are disposed outside the heating roller (the heated member) 5 and a first coil 31, a second coil 32 and a third coil 33 that are wound around the plurality of main cores 20.

The plurality of main cores 20 is the same as or similar to the main core 20 of the above-described embodiment, and therefore, a detailed description thereof is omitted.

The first, second and third coils 31, 32 and 33 are corresponded to the main coil 30 of the above-described embodiment, and generate magnetic fluxes to heat the heating roller 5 in the plurality of main cores 20. The first coil 31 is wound around a plurality of main cores 20 corresponding to a middle portion of the heating roller 5. Since the first coil 31 is wound to surround the plurality of main cores 20, the plurality of main cores 20 is inside the first coil 31. A number of the main cores 20 surrounded by the first coil 31 may be determined according to a width of the smallest printing medium 7 that can be printed by the image forming apparatus 100.

The second coil 32 is wound around at least one main core 20 corresponding to the first end 5-1 of the heating roller 5. In the present embodiment, the second coil 32 is disposed to wind four main cores 20 from a left end of FIG. 7. A main core 20-3 at a boundary between the first coil 31 and the second coil 32 may be wound by both the first coil 31 and the second coil 32. At this time, the second coil 32 is wound around the main core 20-3, and is spaced apart a predetermined distance in the arc direction of the main core 20-3 from and parallel to the first coil 31. The sum of winding numbers (turn numbers) of the first and second coils 31 and 32 wound around the boundary main core 20-3 may be the same as the winding number of the first coil 31 wound around the other main cores 20 or the winding number of the second coil 32 wound around the other main cores 20. Therefore, the winding number of the first coil 31 wound around the boundary main core 20-3 is smaller than the winding number of the first coil 31 wound around the other main core 20, and the winding number of the second coil 32 wound around the boundary main core 20-3 is smaller than the winding number of the second coil 32 wound around the other main core 20. The above-described configuration may prevent the temperature of the portion of the heating roller 5 corresponding to the boundary between the first coil 31 and the second coil 32 from falling.

The third coil 33 is wound around at least one main core 20 corresponding to the second end 5-2 of the heating roller 5 opposite to the first end 5-1 of the heating roller 5. In the present embodiment, the third coil 33 is disposed to wind four main cores 20 from a right end of FIG. 7. A main core 20-4 at a boundary between the first coil 31 and the third coil 33 may be wound by both the first coil 31 and the third coil 33. At this time, the third coil 33 is wound around the main core 20-4 apart a predetermined distance in the arc direction of the main core 20-4 from and parallel to the first coil 31. The winding number of the coil 31 and 33 wound around the main core 20-4 at the boundary between the first coil 31 and the third coil 33 may be determined similarly to the first and second coils 31 and 32 as described above. This configuration may prevent the temperature of the portion of the heating roller 5 corresponding to the boundary between the first coil 31 and the third coil 33 from falling.

The fusing control part 70 of the image forming apparatus 100 can control on/off of the electric power to be applied to the first, second and third coils 31, 32 and 33. In other words, the fusing control part 70 controls the electric power to be applied to the first, second and third coils 31, 32 and 33 according to a size of the printing medium 7 that the image forming apparatus 100 recognizes using a paper sensor, etc. For example, when fusing a small size of printing medium 7, the fusing control part 70 applies the electric power to only the first coil 31 so as to heat only a portion of the heating roller 5 corresponding to the first coil 31. When the size of the printing medium 7 corresponds to the entire length of the heating roller 5, the fusing control part 70 applies the electric power to all of the first, second and third coils 31, 32 and 33 so as to heat a whole area of the heating roller 5. The structure that the plurality of main cores 20 is divided and wound by the first, second and third coils 31, 32 and 33 provides that no cancel coils 60 are required for preventing from overheating of the non-paper passing area of the heating roller 5.

Figure 8:
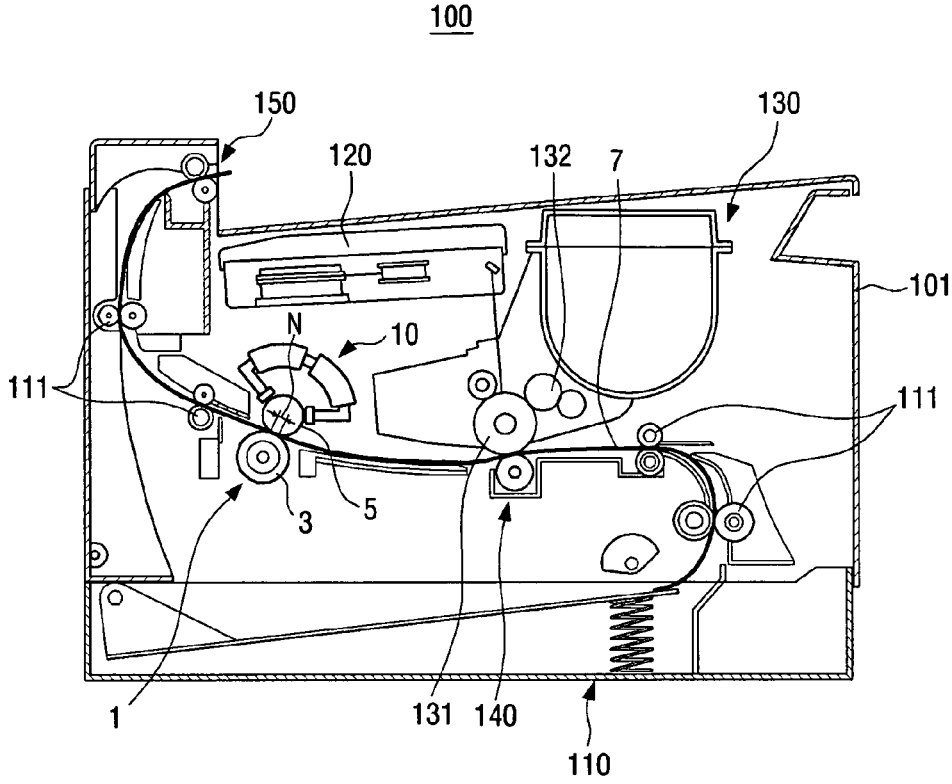
FIG. 8 is a sectional view schematically illustrating an image forming apparatus having a fusing device according to an embodiment.

FIG. 8 is a sectional view schematically illustrating the image forming apparatus 100 having the fusing device 1 according to an embodiment.

The image forming apparatus 100 according to an embodiment performs a printing by an electro photographic method, and may include a laser printer, a copier, a facsimile machine, a composite apparatus of these, etc. Referring to FIG. 8, the image forming apparatus 100 according to an embodiment of the present invention may include a case 101, a printing medium feeding device 110, a developing device 130, the fusing device 1, and a printing medium discharging device 150.

The case 101 forms an outer appearance of the image forming apparatus 100, and may support the printing medium feeding device 110, the developing device 130, the fusing device 1 and the printing medium discharging device 150.

The printing medium feeding device 110 stores a plurality of printing media 7 and supplies the printing medium 7 to the developing device 130. The printing medium 7 picked up by the printing medium feeding device 110 is moved to the developing device 130 by a plurality of conveying rollers 111.

The developing device 130 forms a predetermined image on the printing medium 7 supplied from the printing medium feeding device 110, and may include a photosensitive medium 131 on which a predetermined electrostatic latent image is formed by an exposing device 120, a developing roller 132 which supplies developer to the photosensitive medium 131 to develop the electrostatic latent image into a developer image, and a transferring roller 140 which allows the developer image on the photosensitive medium 131 to be transferred onto the printing medium 7. While the printing medium 7 passes through a transferring nip between the photosensitive medium 131 and the transferring roller 140, the developer image is transferred onto the printing medium 7.

The fusing device 1 allows the developer image transferred on the printing medium 7 to be fused on the printing medium 7, and may include the pressing member 3, the heated member 5, and the magnetic flux generating unit 10 as described above. The heated member 5 of the fusing device 1 is heated according to the size of printing medium 7 supplied from the printing medium feeding device 110 so as to fuse the developer image on the printing medium 7. The operation in which the fusing device 1 allows the developer image to be fused on the printing medium 7 is described above; therefore, a detailed description thereof is not repeated.

The printing medium 7 with the image fused thereon is discharged to outside the image forming apparatus 100 via the conveying roller 111 and the printing medium discharging device 150.

While embodiments have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A fusing device for an image forming apparatus that heats an infused image on a printing medium by an electromagnetic induction heating method, the fusing device comprising:

a heated member having a metallic layer;

a plurality of main cores disposed to be spaced apart a predetermined distance from a surface of the heated member, the plurality of main cores arranged to be spaced apart a predetermined interval from each other in a length direction of the heated member, the plurality of main cores comprising core arms extending from opposite ends of the main core toward the surface of the heated member;

a bottom core is disposed between the heated member and the core arms; and a main coil wound to surround the plurality of main cores.

2. The fusing device of claim 1, wherein the bottom core is attached to the core arms by a resin adhesive.

3. The fusing device of claim 1, wherein the bottom core has a length corresponding to a length of the heated member.

4. The fusing device of claim 1, wherein the core arms are formed in a direction perpendicular to the surface of the heated member.

5. The fusing device of claim 4, wherein when the heated member has a circular section, a distance between the heated member and the bottom core is maintained in a constant dimension and a length of the core arm is determined according to a variation of a diameter of the heated member.

6. The fusing device of claim 1, wherein the heated member is a roller.

7. The fusing device of claim 1, wherein the heated member is a stepless belt unit.

8. The fusing device of claim 7, wherein the stepless belt unit comprises:

a heat pipe disposed adjacent to the plurality of main cores;

a supporting roller disposed to space apart from the heat pipe; and a fusing belt disposed to surround the heat pipe and the supporting roller, the fusing belt to rotate to transmit a heat generated in the heat pipe toward the supporting roller.

9. The fusing device of claim 1, further comprising:

a cancel coil wound around at least one main core corresponding to opposite ends of the heated member among the plurality of main cores, the cancel coil spaced apart from the main coil.

10. The fusing device of claim 9, wherein the cancel coil is separately wound around each of the plurality of main cores.

11. The fusing device of claim 9, further comprising a fusing control part to control an electric power to be applied to the main coil, wherein the fusing control part controls the electric power to be applied to the cancel coil according to a size of the printing medium that the image forming apparatus recognizes.

12. A fusing device for an image forming apparatus that heats an infused image on a printing medium by an electromagnetic induction heating method, the fusing device comprising:

a heated member having a metallic layer;

a bottom core;

a plurality of main cores disposed to be spaced apart a predetermined distance from a surface of the heated member, the plurality of main cores arranged to be spaced apart a predetermined interval from each other in a length direction of the heated member; and a main coil wound to surround the plurality of main cores, wherein the main core is formed in an arc shape corresponding to the surface of the heated member, and the plurality of main cores, the core arms, and the bottom core are formed of a ferrite material.

13. The fusing device of claim 12, wherein the main coil is wound in a width direction of each of the plurality of main cores to surround all the plurality of main cores.

14. A fusing device for an image forming apparatus that heats an infused image on a printing medium by an electromagnetic induction heating method, the fusing device comprising:

a heated member having a metallic layer;

a plurality of main cores disposed to be spaced apart a predetermined distance from a surface of the heated member, the plurality of main cores arranged to be spaced apart a predetermined interval from each other in a length direction of the heated member; and a main coil wound to surround the plurality of main cores, wherein the main coil comprises a first coil wound around a plurality of main cores corresponding to a middle portion of the heated member;

a second coil wound around at least one main core corresponding to a first end of the heated member; and a third coil wound around at least one main core corresponding to a second end opposite to the first end of the heated member.

15. The fusing device of claim 14, wherein each of the second coil and the third coil is wound around each of opposite end main cores of the plurality of main cores wound by the first coil, and is spaced apart a predetermined distance from the first coil.

16. The fusing device of claim 15, further comprising a fusing control part to control an electric power to be applied to the first, second and third coils, wherein the fusing control part controls the electric power to be applied to the first, second and third coils according to a size of the printing medium that the image forming apparatus recognizes.

17. An image forming apparatus, comprising:

a fusing device that heats an infused image on a printing medium by an electromagnetic induction heating method, the fusing device comprising:

a heated member having a metallic layer;

a plurality of main cores disposed to be spaced apart a predetermined distance from a surface of the heated member, the plurality of main cores arranged to be spaced apart a predetermined interval from each other in a length direction of the heated member, the plurality of main cores comprising core arms extending from opposite ends of the main core toward the surface of the heated member;

a bottom core is disposed between the heated member and the core arms; and a main coil wound to surround the plurality of main cores.

18. A fusing device for an image forming apparatus that heats an infused image on a printing medium by an electromagnetic induction heating method, the fusing device comprising:

a heated member having a metallic layer;

a plurality of main cores disposed to be spaced apart a predetermined distance from a surface of the heated member, the plurality of main cores arranged to be spaced apart a predetermined interval from each other in a length direction of the heated member;

a plurality of core arms extending from opposite ends of each of the plurality of main cores toward the heated member;

bottom cores disposed between the heated member and the core arms; and a main coil wound to surround the plurality of main cores.

* * * * *